US007074321B1

(12) United States Patent
Kalnes

(10) Patent No.: US 7,074,321 B1
(45) Date of Patent: Jul. 11, 2006

(54) COMBINATION HYDROCRACKING PROCESS FOR THE PRODUCTION OF LOW SULFUR MOTOR FUELS

(75) Inventor: Tom N. Kalnes, LaGrange, IL (US)

(73) Assignee: UOP LLC, Des Plaines, IL (US)

( * ) Notice: Subject to any disclaimer, the term of this patent is extended or adjusted under 35 U.S.C. 154(b) by 607 days.

(21) Appl. No.: 10/293,382

(22) Filed: Nov. 12, 2002

(51) Int. Cl.
*C10G 47/30* (2006.01)
*C10G 45/02* (2006.01)
*C10G 45/06* (2006.01)
*C10G 65/12* (2006.01)

(52) U.S. Cl. ..... 208/58; 208/59; 208/61; 208/78; 208/89; 208/100; 208/103; 208/105; 208/143; 208/208; 208/210

(58) Field of Classification Search ..... 208/58, 208/59, 61, 78, 89, 100, 103, 105, 143, 208, 208/210

See application file for complete search history.

(56) References Cited

U.S. PATENT DOCUMENTS 5,120,426 A * 6/1992 Johnston et al. ..... 208/100
5,980,729 A * 11/1999 Kalnes et al. ..... 208/89
6,096,191 A 8/2000 Kalnes ..... 208/105
6,190,535 B1 * 2/2001 Kalnes et al. ..... 208/89

* cited by examiner

*Primary Examiner*—Walter D. Griffin
*Assistant Examiner*—Prem C. Singh
(74) *Attorney, Agent, or Firm*—John G. Tolomei; James C. Paschall; John G. Cutts, Jr.

(57) ABSTRACT

An integrated hydrocarbon conversion process for the production of low sulfur fuels utilizing a hydrocracking zone, a diesel hydrodesulfurization zone, a fluid catalytic cracking zone and a gasoline hydrodesulfurization zone. The hydrocracking zone is used to convert at least a portion of the feedstock into diesel boiling range hydrocarbons which are desulfurized in the first hydrodesulfurization zone. The unconverted feedstock is introduced into a fluid catalytic cracking zone to produce gasoline boiling range hydrocarbons which are desulfurized in a second hydrodesulfurization zone.

19 Claims, 1 Drawing Sheet

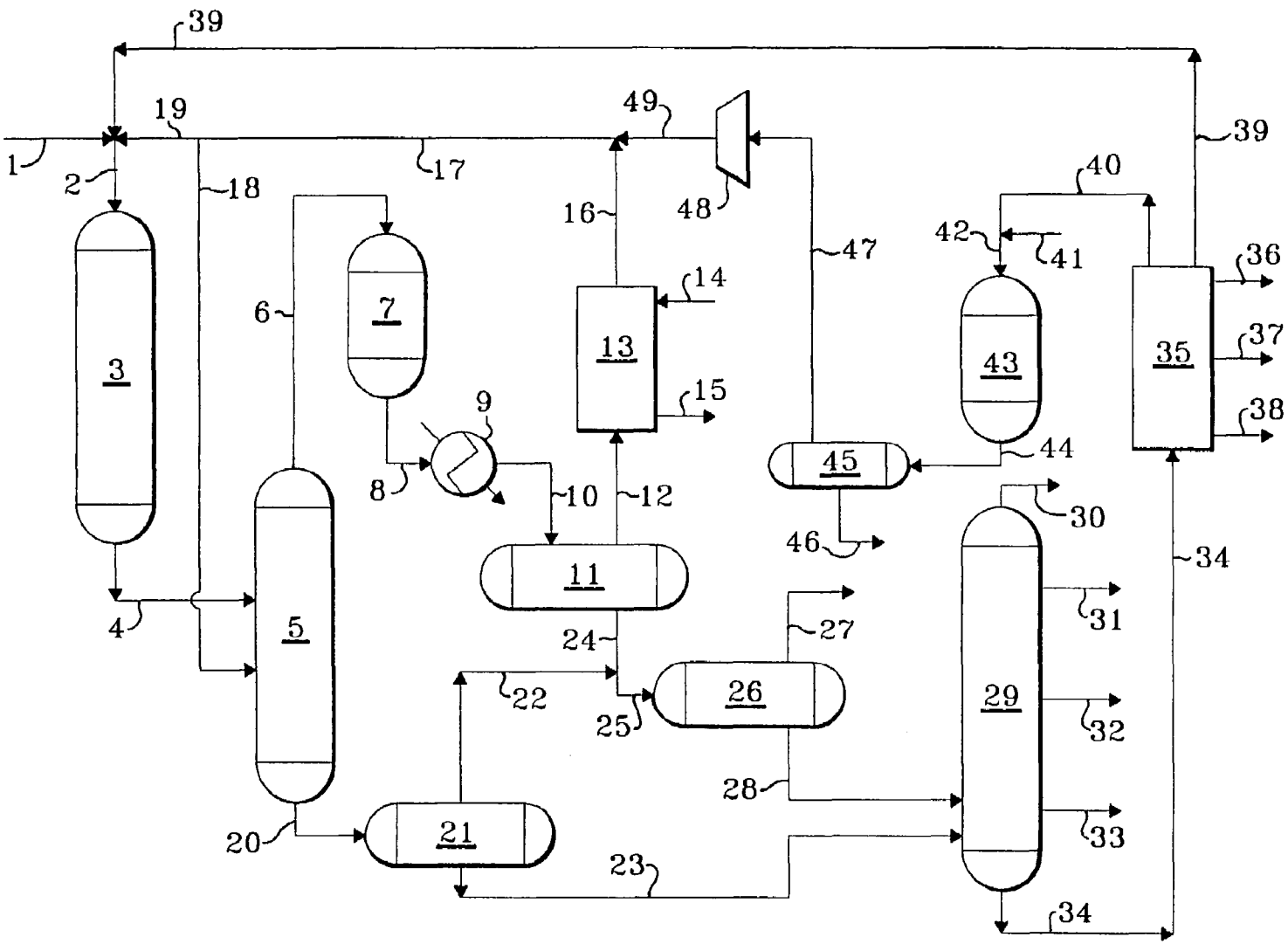
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49

COMBINATION HYDROCRACKING PROCESS FOR THE PRODUCTION OF LOW SULFUR MOTOR FUELS

BACKGROUND OF THE INVENTION

The field of art to which this invention pertains is the hydrocracking of a hydrocarbonaceous feedstock. Petroleum refiners often produce desirable products such as turbine fuel, diesel fuel and other products known as middle distillates as well as lower boiling hydrocarbonaceous liquids such as naphtha and gasoline by hydrocracking a hydrocarbon feedstock derived from crude oil, for example. Feedstocks most often subjected to hydrocracking are gas oils and heavy gas oils recovered from crude oil by distillation. A typical gas oil comprises a substantial portion of hydrocarbon components boiling above about 371° C. (700° F.), usually at least about 50 percent by weight boiling above 371° C. (700° F.). A typical vacuum gas oil normally has a boiling point range between about 315° C. (600° F.) and about 565° C. (1050° F.).

Hydrocracking is generally accomplished by contacting in a hydrocracking reaction vessel or zone the gas oil or other feedstock to be treated with a suitable hydrocracking catalyst under conditions of elevated temperature and pressure in the presence of hydrogen so as to yield a product containing a distribution of hydrocarbon products desired by the refiner. The operating conditions and the hydrocracking catalysts within a hydrocracking reactor influence the yield of the hydrocracked products.

One of the preferred hydrocarbonaceous products from a hydrocracking process is diesel or diesel boiling range hydrocarbons. Marketable products must meet minimum specifications and over the years, it has been recognized that due to environmental concerns and newly enacted rules and regulations, saleable products including diesel fuel must meet lower and lower limits on contaminants such as sulfur and nitrogen. Recently new regulations were proposed in the United States and Europe which basically require the essentially complete removal of sulfur from liquid hydrocarbons which are used as transportation fuels such as gasoline and diesel.

Although a wide variety of process flow schemes, operating conditions and catalysts have been used in commercial hydrocracking activities, there is always a demand for new hydrocracking methods which provide lower costs and improved product characteristics. The present invention is able to economically hydrocrack a hydrocarbonaceous feedstock while simultaneously producing low sulfur diesel and gasoline product.

INFORMATION DISCLOSURE

U.S. Pat. No. 6,096,191 B 1 discloses a catalytic hydrocracking process wherein a hydrocarbonaceous feedstock and a liquid recycle stream are contacted with hydrogen and a hydrocracking catalyst to obtain conversion to lower boiling hydrocarbons. The resulting effluent from the hydrocracking zone is hydrogen stripped at essentially the same pressure as the hydrocracking zone and at least a portion is recycled to the hydrocracking reaction zone.

BRIEF SUMMARY OF THE INVENTION

The present invention is a combination hydrocarbon conversion process which uses a catalytic hydrocracking zone and a fluid catalytic cracking zone (FCC) to produce low sulfur diesel and low sulfur gasoline by utilizing an integrated flow scheme to minimize the capital costs of major equipment as well as utility costs.

One embodiment of the present invention relates to an integrated hydrocarbon conversion process for the production of low sulfur fuels wherein the process comprises the steps of (a) reacting a hydrocarbonaceous feedstock and hydrogen in a hydrocracking zone containing hydrocracking catalyst to produce diesel boiling range hydrocarbons; (b) stripping a hydrocracking zone effluent in a hot, high pressure stripping zone maintained at essentially the same pressure as the hydrocracking zone and a temperature in the range from about 232° C. (450° F.) to about 468° C. (875° F.) with a first hydrogen-rich gaseous stream to produce a first gaseous hydrocarbonaceous stream comprising diesel boiling range hydrocarbons and a first liquid hydrocarbonaceous stream comprising unconverted hydrocarbons; (c) passing the first gaseous hydrocarbonaceous stream comprising diesel boiling range hydrocarbons to a first desulfurization zone containing desulfurization catalyst and producing a desulfurization zone effluent stream; (d) condensing at least a portion of the first desulfurization zone effluent stream to produce a second hydrogen-rich gaseous stream and a second liquid hydrocarbonaceous stream comprising diesel boiling range hydrocarbons; (e) converting at least a portion of the first liquid hydrocarbonaceous stream in a fluid catalytic cracking zone to produce gasoline boiling-range hydrocarbons; (f) reacting at least a portion of the gasoline boiling range hydrocarbons produced in step (e) and a third hydrogen-rich gaseous stream in a second desulfurization zone containing desulfurization catalyst; (g) condensing at least a portion of the second desulfurization zone effluent to produce a fourth hydrogen-rich gaseous stream and a desulfurized gasoline boiling-range hydrocarbon stream; (h) compressing and passing at least a portion of the fourth hydrogen-rich gaseous stream to the hydrocracking zone; (i) passing at least a portion of the second hydrogen-rich gaseous stream to the hydrocracking zone; and (j) recovering a low sulfur diesel product stream and a low sulfur gasoline boiling range hydrocarbon stream.

Another embodiment of the present invention relates to an integrated hydrocarbon conversion process for the production of low sulfur fuels wherein the process comprises the steps of: (a) reacting a hydrocarbonaceous feedstock and hydrogen in a hydrocracking zone containing hydrocracking catalyst to produce diesel boiling range hydrocarbons; (b) stripping a hydrocracking zone effluent in a hot, high pressure stripping zone maintained at essentially the same pressure as the hydrocracking zone and a temperature in the range from about 232° C. (450° F.) to about 468° C. (875° F.) with a first hydrogen-rich gaseous stream to produce a first gaseous hydrocarbonaceous stream comprising diesel boiling range hydrocarbons and a first liquid hydrocarbonaceous stream comprising unconverted hydrocarbons; (c) passing the first gaseous hydrocarbonaceous stream comprising diesel boiling range hydrocarbons to a first desulfurization zone containing desulfurization catalyst and producing a desulfurization zone effluent stream; (d) condensing at least a portion of the first desulfurization zone effluent stream to produce a second hydrogen-rich gaseous stream and a second liquid hydrocarbonaceous stream comprising diesel boiling range hydrocarbons; (e) converting at least a portion of the first liquid hydrocarbonaceous stream in a fluid catalytic cracking zone to produce gasoline boiling-range hydrocarbons and a light cycle oil stream; (f) reacting at least a portion of the gasoline boiling range hydrocarbons produced in step (e) and a third hydrogen-rich gaseous stream in a second desulfurization zone containing desulfurization catalyst; (g) condensing at least a portion of the second desulfurization zone effluent to produce a fourth hydrogen-rich gaseous stream and a desulfurized gasoline boiling-range hydrocarbon stream; (h) compressing and passing at least a portion of the fourth hydrogen-rich gaseous stream to the hydrocracking zone; (i) passing at least a portion of the second hydrogen-rich gaseous stream to the hydrocracking zone; (j) reacting at least a portion of the light cycle oil stream produced in step (e) in the hydrocracking zone; and, (k) recovering a low sulfur diesel product stream and a low sulfur gasoline boiling range hydrocarbon stream.

Yet another embodiment of the present invention relates to an integrated hydrocarbon conversion process for the production of low sulfur fuels wherein the process comprises the steps of (a) reacting a hydrocarbonaceous feedstock and hydrogen in a hydrocracking zone containing hydrocracking catalyst to produce diesel boiling range hydrocarbons; (b) stripping a hydrocracking zone effluent in a hot, high pressure stripping zone maintained at essentially the same pressure as the hydrocracking zone and a temperature in the range from about 232° C. (450° F.) to about 468° C. (875° F.) with a first hydrogen-rich gaseous stream to produce a first gaseous hydrocarbonaceous stream comprising diesel boiling range hydrocarbons and a first liquid hydrocarbonaceous stream comprising unconverted hydrocarbons and diesel boiling range hydrocarbons; (c) passing the first gaseous hydrocarbonaceous stream comprising diesel boiling range hydrocarbons to a first desulfurization zone containing desulfurization catalyst and producing a desulfurization zone effluent stream; (d) condensing at least a portion of the first desulfurization zone effluent stream to produce a second hydrogen-rich gaseous stream and a second liquid hydrocarbonaceous stream comprising diesel boiling range hydrocarbons; (e) converting at least a portion of the first liquid hydrocarbonaceous stream in a fluid catalytic cracking zone to produce gasoline boiling-range hydrocarbons and a light cycle oil stream; (f) passing at least another portion of the first liquid hydrocarbonaceous stream to the first desulfurization zone; (g) reacting at least a portion of the gasoline boiling range hydrocarbons produced in step (e) and a third hydrogen-rich gaseous stream in a second desulfurization zone containing desulfurization catalyst; (h) condensing at least a portion of the second desulfurization zone effluent to produce a fourth hydrogen-rich gaseous stream and a desulfurized gasoline boiling range hydrocarbon stream; (i) compressing and passing at least a portion of the fourth hydrogen-rich gaseous stream to the hydrocracking zone; (j) passing at least a portion of the second hydrogen-rich gaseous stream to the hydrocracking zone; (k) reacting at least a portion of the light cycle oil stream produced in step (e) in the hydrocracking zone; and (l) recovering a low sulfur diesel product stream and a low sulfur gasoline boiling range hydrocarbon stream.

Other embodiments of the present invention encompass further details such as types and descriptions of feedstocks, hydrocracking catalysts and hydrocracking and fluid catalytic cracking preferred operating conditions including temperatures and pressures, all of which are herein after disclosed in the following discussions of each of these facets of the invention.

BRIEF DESCRIPTION OF THE DRAWING

The drawing is a simplified process flow diagram of a preferred embodiment of the present invention. The drawing is intended to be schematically illustrative of the present invention and not be a limitation thereof.

DETAILED DESCRIPTION OF THE INVENTION

It has been discovered that a recovery of low sulfur diesel and low sulfur gasoline with a lower cost of production can be achieved in the above-described integrated hydrocracking process.

The process of the present invention is particularly useful for hydrocracking a feedstock containing hydrocarbons and/or other organic materials to produce a product containing hydrocarbons of lower average boiling point and lower average molecular weight. More particularly, the present invention is readily able to produce essentially sulfur-free diesel and essentially sulfur-free gasoline. The hydrocarbon feedstocks that may be subjected to hydrocracking by the method of the invention include all mineral oils and synthetic oils (e.g., shale oil, tar sand products, etc.) and fractions thereof. Illustrative hydrocarbon feedstocks include those containing components boiling above 288° C. (550° F.), such as atmospheric gas oils, vacuum gas oils, deasphalted, vacuum, and atmospheric residua, hydrotreated residual oils, coker distillates, straight run distillates, pyrolysis-derived oils, high boiling synthetic oils, cycle oils and cat cracker distillates. A preferred hydrocracking feedstock is a gas oil or other hydrocarbon fraction having at least 50% by weight, and most usually at least 75% by weight, of its components boiling at temperatures above the end point of the desired product. One of the most preferred gas oil feedstocks will contain hydrocarbon components which boil above 288° C. (550° F.) with best results being achieved with feeds containing at least 25 percent by volume of the components boiling between 315° C. (600° F.) and 538° C. (1000° F.).

The selected feedstock is introduced into a hydrocracking zone. The hydrocracking zone may contain one or more beds of the same or different catalyst. In one embodiment, when the preferred products are middle distillates the preferred hydrocracking catalysts utilize amorphous bases or low-level zeolite bases combined with one or more Group VIII or Group VIB metal hydrogenating components. In another embodiment, when the preferred products are in the gasoline boiling range, the hydrocracking zone contains a catalyst which comprises, in general, any crystalline zeolite cracking base upon which is deposited a minor proportion of a Group VIII metal hydrogenating component. Additional hydrogenating components may be selected from Group VIB for incorporation with the zeolite base. The zeolite cracking bases are sometimes referred to in the art as molecular sieves and are usually composed of silica, alumina and one or more exchangeable cations such as sodium, magnesium, calcium, rare earth metals, etc. They are further characterized by crystal pores of relatively uniform diameter between about 4 and 14 Angstroms ($10^{-10}$ meters). It is preferred to employ zeolites having a relatively high silica/alumina mole ratio between about 3 and 12. Suitable zeolites found in nature include, for example, mordenite, stilbite, heulandite, ferrierite, dachiardite, chabazite, erionite and faujasite. Suitable synthetic zeolites include, for example, the B, X, Y and L crystal types, e.g., synthetic faujasite and mordenite. The preferred zeolites are those having crystal pore diameters between about 8–12 Angstroms ($10^{-10}$ meters), wherein the silica/alumina mole ratio is about 4 to 6. A prime example of a zeolite falling in the preferred group is synthetic Y molecular sieve.

The natural occurring zeolites are normally found in a sodium form, an alkaline earth metal form, or mixed forms. The synthetic zeolites are nearly always prepared first in the sodium form. In any case, for use as a cracking base it is preferred that most or all of the original zeolitic monovalent metals be ion-exchanged with a polyvalent metal and/or with an ammonium salt followed by heating to decompose the ammonium ions associated with the zeolite, leaving in their place hydrogen ions and/or exchange sites which have actually been decationized by further removal of water. Hydrogen or "decationized" Y zeolites of this nature are more particularly described in U.S. Pat. No. 3,130,006.

Mixed polyvalent metal-hydrogen zeolites may be prepared by ion-exchanging first with an ammonium salt, then partially back exchanging with a polyvalent metal salt and then calcining. In some cases, as in the case of synthetic mordenite, the hydrogen forms can be prepared by direct acid treatment of the alkali metal zeolites. The preferred cracking bases are those which are at least about 10 percent, and preferably at least 20 percent, metal-cation-deficient, based on the initial ion-exchange capacity. A specifically desirable and stable class of zeolites are those wherein at least about 20 percent of the ion exchange capacity is satisfied by hydrogen ions.

The active metals employed in the preferred hydrocracking catalysts of the present invention as hydrogenation components are those of Group VIII, i.e., iron, cobalt, nickel, ruthenium, rhodium, palladium, osmium, iridium and platinum. In addition to these metals, other promoters may also be employed in conjunction therewith, including the metals of Group VIB, e.g., molybdenum and tungsten. The amount of hydrogenating metal in the catalyst can vary within wide ranges. Broadly speaking, any amount between about 0.05 percent and 30 percent by weight may be used. In the case of the noble metals, it is normally preferred to use about 0.05 to about 2 weight percent. The preferred method for incorporating the hydrogenating metal is to contact the zeolite base material with an aqueous solution of a suitable compound of the desired metal wherein the metal is present in a cationic form. Following addition of the selected hydrogenating metal or metals, the resulting catalyst powder is then filtered, dried, pelleted with added lubricants, binders or the like if desired, and calcined in air at temperatures of, e.g., 371–648° C. (700°–1200° F.) in order to activate the catalyst and decompose ammonium ions. Alternatively, the zeolite component may first be pelleted, followed by the addition of the hydrogenating component and activation by calcining. The foregoing catalysts may be employed in undiluted form, or the powdered zeolite catalyst may be mixed and copelleted with other relatively less active catalysts, diluents or binders such as alumina, silica gel, silica-alumina cogels, activated clays and the like in proportions ranging between 5 and 90 weight percent. These diluents may be employed as such or they may contain a minor proportion of an added hydrogenating metal such as a Group VIB and/or Group VIII metal.

Additional metal promoted hydrocracking catalysts may also be utilized in the process of the present invention which comprises, for example, aluminophosphate molecular sieves, crystalline chromosilicates and other crystalline silicates. Crystalline chromosilicates are more fully described in U.S. Pat. No. 4,363,718 (Klotz).

The hydrocracking of the hydrocarbonaceous feedstock in contact with a hydrocracking catalyst is conducted in the presence of hydrogen and preferably at hydrocracking conditions which include a temperature from about (232° C.) (450° F.) to about 468° C. (875° F.), a pressure from about 3448 kPa gauge (500 psig) to about 20685 kPa gauge (3000 psig), a liquid hourly space velocity (LHSV) from about 0.1 to about 30 $hr^{-1}$, and a hydrogen circulation rate from about 337 normal $m^3/m^3$ (2000 standard cubic feet per barrel) to about 4200 normal $m^3/m^3$ (25,000 standard cubic feet per barrel). In accordance with the present invention, the term "substantial conversion to lower boiling products" is meant to connote the conversion of at least 10 volume percent of the fresh feedstock. Total conversion of the feedstock to lower boiling products is preferably less than 80 volume percent, more preferably less than 60 volume percent and even more preferably less than 50 volume percent.

In one embodiment, after the hydrocarbonaceous feedstock has been subjected to hydrocracking as hereinabove described, the resulting effluent from the hydrocracking reaction zone is introduced into a stripping zone maintained at essentially the same pressure as the hydrocracking zone and a temperature from about 232° C. (450° F.) to about 468° C. (875° F.), and counter-currently contacted with a hydrogen-rich gaseous stream to produce a first gaseous hydrocarbonaceous stream containing hydrocarbonaceous compounds comprising diesel boiling range hydrocarbons and a first liquid hydrocarbonaceous stream preferably containing hydrocarbonaceous compounds boiling at a temperature greater than about 371° C. (700° F.). By maintaining the pressure of the stripping zone at essentially the same pressure as the reaction zone is meant that any difference in pressure is due to the pressure drop required to flow the effluent stream from the reaction zone to the stripping zone. It is preferred that the pressure drop is less than about 445 kPa (50 psig).

The resulting first gaseous hydrocarbonaceous stream containing diesel boiling range hydrocarbons is introduced into a desulfurization zone containing desulfurization catalyst. Preferred desulfurization conditions include a temperature from about 204° C. (400° F.) to about 482° C. (900° F.) and a liquid hourly space velocity from about 0.1 to about 10 $hr^{-1}$. It is contemplated that the desulfurization zone may also perform other hydroprocessing reactions such as aromatic saturation, nitrogen removal, cetane improvement and color improvement, for example.

Suitable desulfurization catalysts for use in the present invention are any known conventional hydrotreating catalysts and include those which are comprised of at least one Group VIII metal, preferably iron, cobalt and nickel, more preferably cobalt and/or nickel and at least one Group VI metal, preferably molybdenum and tungsten, on a high surface area support material, preferably alumina. Other suitable desulfurization catalysts include zeolitic catalysts, as well as noble metal catalysts where the noble metal is selected from palladium and platinum. It is within the scope of the present invention that more than one type of desulfurization catalyst be used in the same reaction vessel. The Group VIII metal is typically present in an amount ranging from about 2 to about 20 weight percent, preferably from about 4 to about 12 weight percent. The Group VI metal will typically be present in an amount ranging from about 1 to about 25 weight percent, preferably from about 2 to about 25 weight percent. Typical desulfurization temperatures range from about 204° C. (400° F.) to about 482° C. (900° F.) with pressures from about 2.1 MPa (300 psig) to about 17.3 MPa (2500 psig), preferably from about 2.1 MPa (300 psig) to about 13.9 MPa (2000 psig).

The resulting effluent from the desulfurization zone is partially condensed and introduced into a vapor-liquid separator operated at a temperature from about 21° C. (70° F.) to about 60° C. (140° F.) to produce a hydrogen-rich gaseous stream containing hydrogen sulfide and a second liquid hydrocarbonaceous stream. The resulting hydrogen-rich gaseous stream is preferably passed through an acid gas scrubbing zone to reduce the concentration of hydrogen sulfide to produce a purified hydrogen-rich gaseous stream, a portion of which may then be recycled to the hydrocracking zone and the hot, high pressure stripper. The second liquid hydrocarbonaceous stream is preferably introduced into a cold flash drum to remove dissolved hydrogen and normally gaseous hydrocarbons and subsequently sent to a fractionation zone.

In one embodiment, the first liquid hydrocarbonaceous stream is introduced into a hot flash drum to remove dissolved hydrogen and lower boiling hydrocarbons and then introduced into a fractionation zone. The bottoms stream from the fractionation zone contains unconverted feedstock having a reduced concentration of sulfur. In another embodiment, diesel boiling range hydrocarbons contained in the first liquid hydrocarbonaceous stream are recovered and introduced into the desulfurization zone described hereinabove together with the first gaseous hydrocarbonaceous stream containing diesel boiling range hydrocarbons.

The resulting bottoms stream from the fractionation zone containing unconverted feedstock from the hydrocracking zone and having a reduced concentration of sulfur is introduced into a fluid catalytic cracking (FCC) unit to produce gasoline boiling range hydrocarbons. The FCC unit also produces light cycle oil (LCO) which is a diesel boiling range material with a low cetane number and a relative low value.

Fluid catalytic cracking is accomplished by contacting the feed hydrocarbons in a reaction zone with a catalyst composed of finely divided particulate material. The reaction in catalytic cracking, as opposed to hydrocracking, is carried out in the absence of added hydrogen or the consumption of hydrogen. As the cracking reaction proceeds, substantial amounts of coke are deposited on the catalyst. A high temperature regeneration within a regeneration zone operation burns coke from the catalyst. Coke-containing catalyst, referred to generally by those skilled in the art as spent catalyst, is continually removed from the reaction zone and replaced by lower coke containing catalyst from the regeneration zone. Fluidization of the catalyst particles by various gaseous streams allows the transport of catalyst between the reaction zone and regeneration zone. Methods for cracking hydrocarbons in a fluidized stream of catalyst, for transporting catalyst between reaction and regeneration zones, and for combusting coke in the regenerator are well known by those skilled in the art of FCC processes.

In accordance with the present invention, at least a portion of gasoline boiling range hydrocarbons produced in the FCC unit is introduced into a desulfurization zone containing desulfurization catalyst to reduce the sulfur level and produce a low sulfur gasoline boiling range hydrocarbon stream. Suitable known catalysts and operating conditions may be readily used in the desulfurization zone. The desulfurization zone is supplied with a hydrogen-rich gaseous stream and the hydrogen-rich effluent stream from this desulfurization zone is compressed and introduced into the hydrocracking zone. The term "at least a portion of a stream" is used herein to define a new stream having either essentially the same composition as the original stream or not. In a preferred embodiment, at least a portion of the LCO produced in the FCC unit is directly or indirectly introduced into the hydrocracking zone to upgrade the LCO.

DETAILED DESCRIPTION OF THE DRAWING

In the drawing, the process of the present invention is illustrated by means of a simplified schematic flow diagram in which such details as pumps, instrumentation, heat-exchange and heat-recovery circuits, compressors and similar hardware have been deleted as being non-essential to an understanding of the techniques involved. The use of such miscellaneous equipment is well within the purview of one skilled in the art.

With reference now to the drawing, a feed stream comprising vacuum gas oil is introduced into the process via line 1, is admixed with a hereinafter described liquid hydrocarbonaceous stream provided via line 39 and a hydrogen-rich gaseous stream provided via line 19 and the resulting admixture is transported via line 2 and introduced into hydrocracking zone 3. A resulting hydrocracking zone effluent is transported via line 4 and introduced into hot, high pressure stripper 5 to produce an overhead hydrocarbonaceous vapor stream carried via line 6 and introduced into hydrodesulfurization zone 7. A resulting hydrodesulfurization zone effluent stream carried via line 8 is cooled and partially condensed in heat-exchanger 9 and the resulting cooled and partially condensed stream is carried via line 10 and introduced into high pressure separator 11. A hydrogen-rich gaseous stream is removed from high pressure separator 11 via line 12 and introduced into acid gas recovery zone 13. A lean solvent is introduced via line 14 into acid gas recovery zone 13 and contacts the hydrogen-rich gaseous stream in order to dissolve an acid gas. A rich solvent containing acid gas is removed from acid gas recovery zone 13 via line 15 and recovered. A hydrogen-rich gaseous stream containing a reduced concentration of acid gas is removed from acid gas recovery zone 13 via line 16 and is admixed with a hydrogen makeup stream provided via line 49 and the resulting admixture is transported via line 17. The hydrogen-rich gaseous stream carried via line 17 is bifurcated and a first portion is carried via line 19 and is introduced into hydrocracking zone 3 via line 2 as hereinabove described and a second stream is carried via line 18 and is introduced as stripping gas into hot, high pressure stripper 5. A liquid hydrocarbonaceous stream is removed from hot, high pressure stripper 5 via line 20 and is introduced into hot flash drum 21 to produce a vaporous stream carried via line 22 which is cooled by a heat exchange, not shown, and the resulting cooled stream is carried via line 22 and is admixed with a hereinafter described hydrocarbonaceous liquid stream provided via line 24 and the resulting admixture is carried via line 25 and introduced into cold flash drum 26. A normally gaseous hydrocarbonaceous stream is removed from cold flash drum 26 via line 27 and recovered. A liquid stream is removed from cold flash drum 26 via line 28 and introduced into fractionation zone 29. A liquid hydrocarbonaceous stream containing unconverted feedstock and diesel boiling range hydrocarbons is removed from hot flash drum 21 via line 23 and introduced into fractionation zone 29. A liquid hydrocarbonaceous stream is removed from the bottom of fractionation zone 29 via line 34 and is introduced into fluid catalytic cracking zone 35. A $C_3$–$C_4$ stream is removed from fluid catalytic cracking zone 35 via line 36 and recovered. A gasoline boiling range hydrocarbon is removed from fluid catalytic cracking zone 35 via line 37 and recovered. A clarified slurry oil stream is removed from fluid catalytic cracking zone 35 via line 38 and recovered. A heavy gasoline boiling range hydrocarbon is removed from fluid catalytic cracking zone 35 via line 40 and is admixed with a hydrogen-rich gaseous stream provided via line 41 and the resulting admixture is carried via line 42 and introduced into desulfurization zone 43. A resulting desulfurized stream is removed from desulfurization zone 43 via line 44 and partially condensed and introduced into vapor liquid separator 45. A liquid stream containing gasoline boiling range hydrocarbons is removed from vapor liquid separator 45 via line 46 and recovered. A hydrogen-rich gaseous stream is removed from vapor liquid separator 45 via line 47, compressed in compressor 48, carried via line 49 and admixed with a hereinabove described hydrogen-rich gaseous stream provided via line 16. A light cycle oil stream is removed from fluid catalytic cracking zone 35 via line 39 and is introduced via line 2 into hydrocracking zone 3. A normally gaseous hydrocarbonaceous stream is removed from fractionation zone 29 via line 30 and recovered. A naphtha or gasoline boiling range hydrocarbon stream is removed from fractionation zone 29 via line 31 and recovered. A kerosene boiling range hydrocarbon stream is removed via line 32 from fractionation zone 29 and recovered. A diesel boiling range hydrocarbon stream is removed from fractionation zone 29 via line 33 and recovered. A bottom stream from fractionation zone 29 is carried via lines 34 and introduced into fluid catalytic cracking zone 35 as hereinabove described.

The process of the present invention is further demonstrated by the following illustrative embodiment. This illustrative embodiment is, however, not presented to unduly limit the process of this invention, but to further illustrate the advantage of the hereinabove-described embodiment. The following data were not obtained by the actual performance of the present invention but are considered prospective and reasonably illustrative of the expected performance of the invention.

ILLUSTRATIVE EMBODIMENT

A vacuum gasoil (VGO) feedstock in an amount of 5615 $m^3$/day (35315 BPSD) and having the characteristics presented in Table 1 is hydrocracked in a partial conversion hydrocracking zone operated at a temperature of about 382° C. (730° F.) and an outlet pressure of 9.1 MPa (1300 psig) to provide an overall conversion of about 30 volume percent gross. The resulting effluent from the hydrocracker is introduced into a hot, high pressure stripper operated at about 9.1 MPa (1300 psig) and stripped with a hydrogen-rich gaseous stream. An overhead gaseous hydrocarbonaceous stream containing diesel boiling range hydrocarbons from the hot, high pressure stripper is introduced into a desulfurization zone operated at a pressure of 8.9 MPa (1275 psig) and a temperature of 365° C. (690° F.). The effluent from the desulfurization zone is cooled and partially condensed to produce a hydrogen-rich gaseous stream and a liquid hydrocarbonaceous stream which is flashed and fractionated.

A liquid hydrocarbonaceous stream containing unconverted feedstock is removed from the bottom of the hot, high pressure stripper and separated to produce a stream containing unconverted, desulfurized feedstock in an amount of 3995 $m^3$/day (25139 BPSD) which is charged to a fluid catalytic cracking (FCC) zone to produce 1185 $m^3$/day (7456 BPSD) of $C_3$ and $C_4$ hydrocarbons, 2160 $m^3$/day (13592 BPSD) of gasoline, 477 $m^3$/day (3000 BPSD) of heavy gasoline, 376 $m^3$/day (2367 BPSD) of light cycle oil (LCO) and 218 $m^3$/day (1375 BPSD) of clarified slurry oil. The FCC also produced 167 metric tons per day of coke.

The 477 $m^3$/day (3000 BPSD) of heavy gasoline from the FCC and having a normal boiling range from 138° C. (280° F.) to 193° C. (380° F.) and sulfur content of 80 wppm sulfur is introduced into a desulfurization zone operated at a pressure of 3.9 MPa (550 psig) and a temperature of 232° C. (450° F.) to produce a heavy gasoline product stream in an amount of about 477 $m^3$/day (3000 BPSD) having a sulfur concentration of about 20 wppm sulfur. The once-through hydrogen stream recovered from this desulfurization zone is compressed and introduced into the hydrocracking zone. The 376 $m^3$/day (2367 BPSD) of light cycle oil is introduced into the hydrocracking zone.

The yields from the hydrocracking zone are presented in Table 2.

TABLE 1

| Feedstock Analysis | | |
|---|---|---|
| Specific Gravity | 0.926 | |
| Sulfur, weight percent | 1.91 | |
| Distillation, ° C. (° F.) | | |
| Initial Boiling Point | 605 | (318) |
| 50% | 847 | (453) |
| End Point | 1085 | (582) |

TABLE 2

| Hydrocracking Zone Yields | | | |
|---|---|---|---|
| | $m^3$/day (BPSD) | | Sulfur, wppm |
| LPG | 54.3 | (342) | — |
| Naphtha | 361 | (2273) | <0.5 |
| Low Sulfur Diesel | 1898 | (11946) | <10 |
| FCC Feed | 3995 | (25,139) | 200 |

The foregoing description, drawing and illustrative embodiment clearly illustrate the advantages encompassed by the process of the present invention and the benefits to be afforded with the use thereof.

What is claimed is:

1. An integrated hydrocarbon conversion process for the production of low sulfur fuels wherein the process comprises the steps of:

(a) reacting a hydrocarbonaceous feedstock and hydrogen in a hydrocracking zone containing hydrocracking catalyst to produce diesel boiling range hydrocarbons;

(b) stripping a hydrocracking zone effluent in a hot, high pressure stripping zone maintained at essentially the same pressure as the hydrocracking zone and a temperature in the range from about 232° C. (450° F.) to about 468° C. (875° F.) with a first hydrogen-rich gaseous stream to produce a first gaseous hydrocarbonaceous stream comprising diesel boiling range hydrocarbons and a first liquid hydrocarbonaceous stream comprising unconverted hydrocarbons;

(c) passing the first gaseous hydrocarbonaceous stream comprising diesel boiling range hydrocarbons to a first desulfurization zone containing desulfurization catalyst and producing a desulfurization zone effluent stream;

(d) condensing at least a portion of the first desulfurization zone effluent stream to produce a second hydrogen-rich gaseous stream and a second liquid hydrocarbonaceous stream comprising diesel boiling range hydrocarbons;

(e) converting at least a portion of the first liquid hydrocarbonaceous stream in a fluid catalytic cracking zone to produce gasoline boiling-range hydrocarbons;

(f) reacting at least a portion of the gasoline boiling range hydrocarbons produced in step (e) and a third hydrogen-rich gaseous stream in a second desulfurization zone containing desulfurization catalyst;

(g) condensing at least a portion of the second desulfurization zone effluent to produce a fourth hydrogen-rich gaseous stream and a desulfurized gasoline boiling-range hydrocarbon stream;

(h) compressing and passing at least a portion of the fourth hydrogen-rich gaseous stream to the hydrocracking zone;

(i) passing at least a portion of the second hydrogen-rich gaseous stream to the hydrocracking zone; and (j) recovering a low sulfur diesel product stream and a low sulfur gasoline boiling range hydrocarbon stream.

2. The process of claim 1 wherein at least 25% by volume of the hydrocarbonaceous feedstock boils between about 315° C. (600° F.) and about 538° C. (1000° F.).

3. The process of claim 1 wherein the hydrocracking zone is operated at conditions which include a temperature from about 232° C. (450° F.) to about 468° C. (875° F.) and a pressure from about 3.45 MPa (500 psig) to about 20.7 MPa (3000 psig).

4. The process of claim 1 wherein the conversion of the feedstock in the hydrocracking zone is preferably less than 80 volume percent, more preferably 60 volume percent and even more preferably less than 50 volume percent.

5. The process of claim 1 wherein at least a majority of the diesel boiling range hydrocarbons boils in the range from about 154° C. (309° F.) to about 370° C. (698° F.).

6. The process of claim 1 wherein at least a portion of the second hydrogen-rich gaseous stream is recycled to the hot, high pressure stripping zone in step (b).

7. The process of claim 1 wherein the low sulfur diesel product stream comprises less than about 50 wppm sulfur.

8. The process of claim 1 wherein the low sulfur diesel product stream comprises less than about 10 wppm sulfur.

9. The process of claim 1 wherein the hydrocarbonaceous feedstock is selected from the group consisting of atmospheric gas oils, vacuum gas oils, deasphalted, vacuum, and atmospheric residua, hydrotreated residual oils, coker distillates, straight run distillates, pyrolysis-derived oils, high boiling synthetic oils, cycle oils and cat cracker distillates.

10. An integrated hydrocarbon conversion process for the production of low sulfur fuels wherein the process comprises the steps of:

(a) reacting a hydrocarbonaceous feedstock and hydrogen in a hydrocracking zone containing hydrocracking catalyst to produce diesel boiling range hydrocarbons;

(b) stripping a hydrocracking zone effluent in a hot, high pressure stripping zone maintained at essentially the same pressure as the hydrocracking zone and a temperature in the range from about 232° C. (450° F.) to about 468° C. (875° F.) with a first hydrogen-rich gaseous stream to produce a first gaseous hydrocarbonaceous stream comprising diesel boiling range hydrocarbons and a first liquid hydrocarbonaceous stream comprising unconverted hydrocarbons;

(c) passing the first gaseous hydrocarbonaceous stream comprising diesel boiling range hydrocarbons to a first desulfurization zone containing desulfurization catalyst and producing a desulfurization zone effluent stream;

(d) condensing at least a portion of the first desulfurization zone effluent stream to produce a second hydrogen-rich gaseous stream and a second liquid hydrocarbonaceous stream comprising diesel boiling range hydrocarbons;

(e) converting at least a portion of the first liquid hydrocarbonaceous stream in a fluid catalytic cracking zone to produce gasoline boiling-range hydrocarbons and a light cycle oil stream;

(f) reacting at least a portion of the gasoline boiling range hydrocarbons produced in step (e) and a third hydrogen-rich gaseous stream in a second desulfurization zone containing desulfurization catalyst;

(g) condensing at least a portion of the second desulfurization zone effluent to produce a fourth hydrogen-rich gaseous stream and a desulfurized gasoline boiling-range hydrocarbon stream;

(h) compressing and passing at least a portion of the fourth hydrogen-rich gaseous stream to the hydrocracking zone;

(i) passing at least a portion of the second hydrogen-rich gaseous stream to the hydrocracking zone;

(j) reacting at least a portion of the light cycle oil stream produced in step (e) in the hydrocracking zone; and (k) recovering a low sulfur diesel product stream and a low sulfur gasoline boiling range hydrocarbon stream.

11. The process of claim 10 wherein at least 25% by volume of the hydrocarbonaceous feedstock boils between about 315° C. (600° F.) and about 538° C. (1000° F.).

12. The process of claim 10 wherein the hydrocracking zone is operated at conditions which include a temperature from about 232° C. (450° F.) to about 468° C. (875° F.) and a pressure from about 3.45 MPa (500 psig) to about 20.7 MPa (3000 psig).

13. The process of claim 10 wherein the conversion of the feedstock in the hydrocracking zone is preferably less than 80 volume percent, more preferably 60 volume percent and even more preferably less than 50 volume percent.

14. The process of claim 10 wherein at least a majority of the diesel boiling range hydrocarbons boils in the range from about 154° C. (309° F.) to about 370° C. (698° F.).

15. The process of claim 10 wherein at least a portion of the second hydrogen-rich gaseous stream is recycled to the hot, high pressure stripping zone in step (b).

16. The process of claim 10 wherein the low sulfur diesel product stream comprises less than about 50 wppm sulfur.

17. The process of claim 10 wherein the low sulfur diesel product stream comprises less than about 10 wppm sulfur.

18. The process of claim 10 wherein the hydrocarbonaceous feedstock is selected from the group consisting of atmospheric gas oils, vacuum gas oils, deasphalted, vacuum, and atmospheric residua, hydrotreated residual oils, coker distillates, straight run distillates, pyrolysis-derived oils, high boiling synthetic oils, cycle oils and cat cracker distillates.

19. An integrated hydrocarbon conversion process for the production of low sulfur fuels wherein the process comprises the steps of:

(a) reacting a hydrocarbonaceous feedstock and hydrogen in a hydrocracking zone containing hydrocracking catalyst to produce diesel boiling range hydrocarbons;

(b) stripping a hydrocracking zone effluent in a hot, high pressure stripping zone maintained at essentially the same pressure as the hydrocracking zone and a temperature in the range from about 232° C. (450° F.) to about 468° C. (875° F.) with a first hydrogen-rich gaseous stream to produce a first gaseous hydrocarbonaceous stream comprising diesel boiling range hydrocarbons and a first liquid hydrocarbonaceous stream comprising unconverted hydrocarbons and diesel boiling range hydrocarbons;

(c) passing the first gaseous hydrocarbonaceous stream comprising diesel boiling range hydrocarbons to a first desulfurization zone containing desulfurization catalyst and producing a desulfurization zone effluent stream;

(d) condensing at least a portion of the first desulfurization zone effluent stream to produce a second hydrogen-rich gaseous stream and a second liquid hydrocarbonaceous stream comprising diesel boiling range hydrocarbons;

(e) converting at least a portion of the first liquid hydrocarbonaceous stream in a fluid catalytic cracking zone to produce gasoline boiling-range hydrocarbons and a light cycle oil stream;

(f) passing at least another portion of the first liquid hydrocarbonaceous stream to the first desulfurization zone;

(g) reacting at least a portion of the gasoline boiling range hydrocarbons produced in step (e) and a third hydrogen-rich gaseous stream in a second desulfurization zone containing desulfurization catalyst;

(h) condensing at least a portion of the second desulfurization zone effluent to produce a fourth hydrogen-rich gaseous stream and a desulfurized gasoline boiling range hydrocarbon stream;

(i) compressing and passing at least a portion of the fourth hydrogen-rich gaseous stream to the hydrocracking zone;

(j) passing at least a portion of the second hydrogen-rich gaseous stream to the hydrocracking zone;

(k) reacting at least a portion of the light cycle oil stream produced in step(e) in the hydrocracking zone; and (l) recovering a low sulfur diesel product stream and a low sulfur gasoline boiling range hydrocarbon stream.

* * * * *